United States Patent [19]

Kaufman et al.

[11] 4,416,667

[45] Nov. 22, 1983

[54] METHANOL, ETHANOL, OR GASOHOL FUEL CONTAINING AS A WEAR-INHIBITING ADDITIVE A REACTION PRODUCT OF AN ETHER-AMINE WITH A PHOSPHATE OR A SUBSTITUTED PHOSPHONIC ACID

[75] Inventors: Benjamin J. Kaufman, Wappingers Falls; Rodney L. Sung, Fishkill; William M. Sweeney, Wappingers Falls, all of N.Y.

[73] Assignee: Texaco Inc., White Plains, N.Y.

[21] Appl. No.: 336,156

[22] Filed: Dec. 31, 1981

[51] Int. Cl.[3] ..... C10L 1/26

[52] U.S. Cl. ..... 44/56; 44/53; 44/71; 44/72; 44/76; 260/924; 260/925

[58] Field of Search ..... 44/53, 56, 71, 72, 76; 260/924, 925

[56] References Cited

U.S. PATENT DOCUMENTS

| | | | |
|---|---|---|---|
| 3,236,614 | 2/1966 | Young et al. | 44/72 |
| 3,238,277 | 3/1966 | Sigan et al. | 44/72 |
| 4,328,003 | 5/1982 | Ryer et al. | 44/71 |

*Primary Examiner*—Charles F. Warren
*Assistant Examiner*—Y. Harris-Smith
*Attorney, Agent, or Firm*—Carl G. Ries; Robert A. Kulason; Carl G. Seutter

[57] ABSTRACT

A novel fuel composition contains ethanol or gasohol plus, as a wear-inhibiting additive, a quaternary ammonium reaction product of an ether amine $(R\text{-}O\text{-}R'')_a\text{-}NH_{3-a}$, typically $C_{13}H_{27}\text{-}O\text{-}(CH_2)_3\text{-}NH_2$ and a phosphate or phosphonate, typically tetradecyl phosphonate.

37 Claims, No Drawings

METHANOL, ETHANOL, OR GASOHOL FUEL CONTAINING AS A WEAR-INHIBITING ADDITIVE A REACTION PRODUCT OF AN ETHER-AMINE WITH A PHOSPHATE OR A SUBSTITUTED PHASPHONIC ACID

FIELD OF THE INVENTION

This invention relates to alcohol products particularly characterized by decreased ability to corrode metal surfaces with which they come into contact.

BACKGROUND OF THE INVENTION

As is well known to those skilled in the art, alcohols such as ethanol may corrode metal surfaces with which they come into contact. This is particularly true of crude or commercially available ethanols which undesirably contain acidic components commonly acetic acid. In the case of fermentation alcohols, acetic acid may be present in amount of 0.003 w %-0.005 w % of the alcohol; and this may be responsible for the fact that the alcohol causes serious corrosion problems.

It is an object of this invention to provide a novel process for decreasing the corrosion of alcohol compositions. Other objects will be apparent to those skilled in the art.

STATEMENT OF THE INVENTION

In accordance with certain of its aspects, the novel composition of this invention may comprise (a) a major portion of a fuel containing (i) at least one alcohol selected from the group consisting of methanol and ethanol and (ii) gasoline in amount of 0–50 volumes per volume of alcohol; and (b) a minor effective wear-inhibiting amount of as wear-inhibiting agent a reaction product of (i) an amine having the formula $(R\text{-}O\text{-}R'')_a\text{-}NH_{3-a}$ wherein R contains 1–30 carbon atoms and is selected from the group consisting of alkyl, alkenyl, alkaryl, aralkyl, cycloalkyl, and aryl groups and R″ is a divalent hydrocarbon group containing 1–30 carbon atoms and is selected from the group consisting of alkylene, alkenylene, alkarylene, aralkylene, cycloalkylene, and arylene groups, and a is an integer 1-3 with (ii) a phosphonic acid

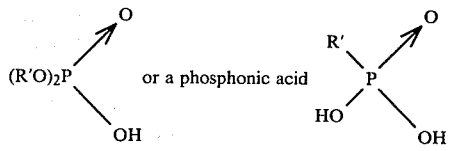

wherein R′ contains 1–30 carbon atoms and is selected from the group consisting of alkyl, alkenyl, alkaryl, aralkyl, cycloalkyl, and aryl.

DESCRIPTION OF THE INVENTION

The fuel for internal conbustion engines which may be treated by the process of this invention may contain (i) at least one alcohol selected from the group consisting of ethanol and methanol and (ii) gasoline in amount of 0–50 volumes per volume of alcohol. The fuel may be an alcohol-type fuel containing little or no hydrocarbon. Typical of such fuels are methanol, ethanol, mixtures of methanol-ethanol, etc. Commercially available mixtures may be employed. Illustrative of one such commercially available mixture may be that having the following typical analysis.

TABLE I

| Component | Parts |
|---|---|
| ethanol | 3157.2 |
| methyl isobutyl ketone | 126.3 |
| acetic acid | 0.256 |
| methyl alcohol | 0.24 |
| isopropyl alcohol | 0.2 |
| n-propyl alcohol | 0.162 |
| ethyl acetate | 0.2 |

The fuels which may be treated by the process of this invention include gasohols which may be formed by mixing 90–95 volumes of gasoline with 5–10 volumes of ethanol or methanol. A typical gasohol may contain 90 volumes of gasoline and 10 volumes of absolute alcohol.

It is preferred that the fuels to be treated by the process of this invention by substantially anhydrous i.e. that they contain less than about 0.3 v % water; typically they may contain 0.0001 v %—0.005 v %, say about 0.04 v % water.

It is a feature of these fuels that they may undesirably contain acidic contaminants which may cause serious corrosion problems. These contaminants are particularly in evidence when the alcohol is a commercially available alcohol which contains therein inter alia acids concurrently produced as by fermentation processes for producing ethanol or acids which have been picked up during handling. Acetic acid is a common acid present in the commercially available alcohols produced by fermentation; and it may be present in amount of 0.003 w % 0.005 w % of the total of the alcohol.

In accordance with practice of the process of this invention, there may be added to the fuel a minor wearinhibiting amount of, as a wear-inhibiting additive, a quaternary ammonium reaction product of (i) an amine $(ROR'')_a\text{—}NH_{3-a}$ with (ii) a phosphate ester or a phosphonic acid.

The amine reactants which may be employed in accordance with practice of the process of this invention, include those having the formula $(R\text{-}O\text{-}R'')_a\text{-}NH_{3-a}$ wherein R contains 1–30 carbon atoms and is selected from the group consisting of alkyl, alkenyl, alkaryl, aralkyl, cycloalkyl, and aryl groups and R″ is a divalent hydrocarbon group containing 1–30 carbon atoms and is selected from the group consisting of alkyl, alkenyl, alkaryl, aralkyl, cycloalkyl, and aryl groups, and a is an integer 1–3.

In the above compound, R may be a hydrocarbon radical selected from the group consisting of alkyl, aralkyl, cycloalkyl, aryl, alkaryl, and alkenyl, including such radicals when inertly substituted. When R is alkyl, it may typically be methyl, ethyl, n-propyl, iso-propyl, n-butyl, 1-butyl, sec-buty, amyl, octyl, decyl, octadecyl, etc. When R is aralkyl, it may typically be benzyl, beta-phenylethyl, etc. When R is cycloalkyl, it may typically be cyclohexyl, cycloheptyl, cyclooctyl, 2-methylcycloheptyl, 3-butylcyclohexyl, 3-methylcyclohexyl, etc. When R is aryl, it may typically be phenyl, naphthyl, etc. When R is alkaryl, it may typically be tolyl, xylyl, etc. When R is alkenyl, it may typically be vinyl, allyl, 1-butenyl, etc. R may be inertly substituted i.e. it may bear a non-reactive substituent such as alkyl, aryl, cycloalkyl, ether, etc. Typically inertly substituted R groups may include 2-ethoxyethyl, carboethoxymethyl, 4-methyl cyclohexyl, etc. The preferred R groups may be alkyl group having 6–20 carbon atoms including eg hexyls, oxtyls, decyls, etc. R may preferably be a $C_6$–$C_{15}$ more preferably a $C_{13}$ straight chain alkyl-tridecyl.

R″ is a divalent hydrocarbon group which may be selected from the same group as that from which R is selected but having one less hydrocarbon atom. Preferably R″ is a $C_2$-$C_6$ group more preferably a $C_2$-$C_3$ group i.e. $-CH_2-CH_2-$, $-CH_2-CH_2-CH_2$, or $$-CH_2-\underset{\underset{CH_3}{|}}{CH}-.$$

In the formula a is an integer 1-3. It will be apparent that when a is 3, the formula may be $(ROR'')_3N$ and the compositions may be tertiary amines typified by:

TABLE

| |
|---|
| $(C_{13}H_{27}O\ CH_2CH_2CH_2)_3N$ |
| $(C_{12}H_{25}O\ CH_2CH_2)_3N$ |
| $(C_{10}H_{21}O\ CH_2CH_2CH_2)_3N$ |

It will be apparent that when a is 2, the formula may be $$(ROR'')_2\ NH$$

and the compositions may be secondary amines typified by:

TABLE

| |
|---|
| $(C_{13}H_{27}O\ CH_2CH_2CH_2)_2NH$ |
| $(C_{12}H_{25}O\ CH_2CH_2)_2NH$ |
| $(C_{10}H_{21}O\ CH_2CH_2CH_2)_2NH$ |

It will be apparent that when a is 1, the formula will be that of the preferred amines, and the compositions may be primary amines typified by:

TABLE

| |
|---|
| tridecyl (oxypropyl) amine |
| $C_{13}H_{27}O\ CH_2CH_2CH_2—NH_2$ |
| $C_{12}H_{25}O\ CH_2CH_2—NH_2$ |
| $C_{10}H_{21}O\ CH_2CH_2CH_2—NH_2$ |

The preferred compositions may be the primary amines $$R—O—R''—NH_2$$

The compositions wherein R″ is $(-CH_2-)_3$ may be particularly preferred. A particularly preferred composition may be $C_{13}H_{27}O\ CH_2CH_2CH_2-NH_2$.

These compositions may be available commercially or they may be synthesized by reaction of an alcohol with an unsaturated nitrile to produce eg an alkoxyalkyl nitrile which may then be hydrogenated to the amine. An illustrative reaction may be that starting with acrylonitrile and the alcohol:

$$C_{13}H_{27}OH + CH_2{=}CH_2{-}C{\equiv}N \longrightarrow C_{13}H_{27}{-}O{-}CH_2CH_2C{\equiv}N$$

$$C_{13}H_{27}{-}O{-}CH_2CH_2C{\equiv}N + 2H_2 \xrightarrow[\text{catalyst}]{\text{Pton C}} C_{13}H_{27}{-}O{-}CH_2CH_2CH_2{-}NH_2$$

Illustrative commercially available compositions may be the following, the first listed being a preferred composition:

TABLE

| |
|---|
| A. The Armeen EA-13 brand of tridecyl (oxypropyl) amine |
| $C_{13}H_{27}—O—(CH_2)_3—NH_2$ |
| B. The Armeen EA-80 brand of a mixture containing |
| 5 w % $C_6H_{13}—O—(CH_2)_3—NH_2$ |
| 56 w % $C_8H_{17}—O—(CH_2)_3—NH_2$ |
| 39 w % $C_{10}H_{21}—O—(CH_2)_3—NH_2$ |
| C. The Armeen EA-25 brand of a mixture containing |
| 20 w % $C_{12}H_{25}—O—(CH_2)_3—NH_2$ |
| 30 w % $C_{13}H_{27}—O—(CH_2)_3—NH_2$ |
| 30 w % $C_{14}H_{29}—O—(CH_2)_3—NH_3$ |
| 20 w % $C_{20}H_{41}—O—(CH_2)_3—NH_2$ |

The phosphonic acid reactants which may be employed may be characterized by the formula

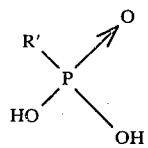

wherein R′ contains 1–30, preferably 5–30, more preferably 10–18, say 14 carbon atoms and is selected from the group consisting of alkyl, alkenyl, alkaryl, aralkyl, cycloalkyl, and aryl hydrocarbon moities.

In the above compound, R′ may be a hydrocarbon radical selected from the group consisting of alkyl, aralkyl, cycloalkyl aryl, alkaryl, alkenyl, and alkynyl including such radicals when inertly substituted. When R′ is alkyl, it may typically be methyl, ethyl, n-propyl, iso-propyl, n-butyl, i-butyl, sec-buty, amyl, octyl, decyl, octadecyl, etc. When R′ is aralkyl, it may typically be benzyl, beta-phenylethyl, etc. When R′ is cycloalkyl, it may typically be cyclohexyl, cycloheptyl, cyclooctyl, 2-methylcycloheptyl, 3-butylcyclohexyl, 3-methylcyclohexyl, etc. When R′ is aryl, it may typically be tolyl, xylyl, etc. When R′ is alkenyl, it may typically be vinyl, allyl, 1-butenyl, etc. When R′ is alkynyl, it may typically be ethynyl, propynyl, butynyl, etc. R′ may be inertly substituted i.e. it may bear a non-reactive substituent such as alkyl, aryl, cycloalkyl, ether, halogen, nitro, etc. Typically inertly substituted R′ groups may include 3-chloropropyl, 2-ethoxyethyl, carboethoxymethyl, 4-methyl cyclohexyl, p-chlorophenyl, p-chlorobenzyl, 3-chloro-3-methylphenyl, etc. The preferred R′ groups may be alkyl group, containing 10–18 carbon atoms. R′ may preferably be $C_{14}$, a tetradecyl group when the compound is a phosphonic acid and $C_{12}$ lauryl when the compound is a phosphate.

These phosphonic acid may be readily available or they may be prepared typically by the reaction of olefins with phosphites. In a typical reaction, one gram mole of tetradecene may be reacted with 1.5 gram moles of dimethyl phosphite and a catalytic amount (4 g) of ditertiary-butyl peroxide. The mixture is heated at 150° C. for 4 hours. After cooling, aqueous hydrochloric acid is added and the mixture extracted with toluene solvent. The solvent mixture is separated and toluene is stripped off to leave the 1:1 adduct—typically tetradecyl phosphonic acid.

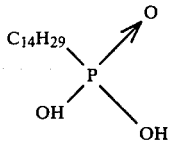

Illustrative phosphonic acid which may be employed may include:

TABLE

| | |
|---|---|
| tetradecyl | phosphonic acid |
| decyl | phosphonic acid |
| dodecyl | phosphonic acid |
| nonyl | phosphonic acid |

Preparation of the quaternary products of this invention may be carried out by reacting one mole of the phosphonate with one mole of the ether-amine.

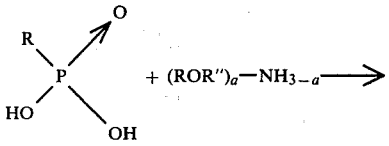

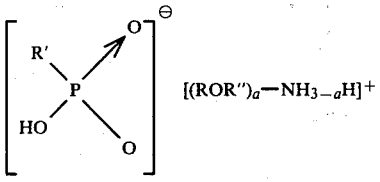

The product may be further reacted with another mole (bimolar amounts in total) of amine to yield the bimolar product.

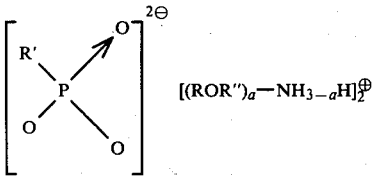

Reaction may be carried out typically by reacting equivalent quantities of reactants in a reaction operation at 20° C.–100° typically 20° C.–50° C., say 25° C. or ambient temperature and 0–500 psig, typically 0–100 psig, say atmospheric pressure for 0.1–4 hours, say 0.75 hours. If desired, reaction may be carried out in the presence of an excess of absolute alcohol, preferably ethanol, or hydrocarbon, typically toluene or xylene or isooctane. Reaction product may be employed without further purification.

TABLE

A

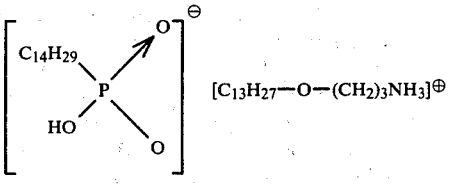

TABLE-continued

B

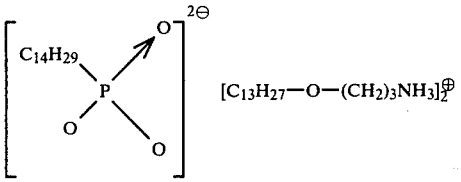

C

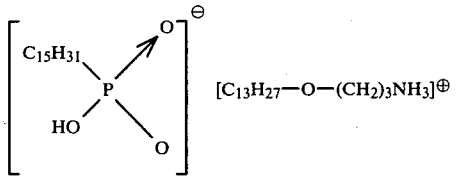

D

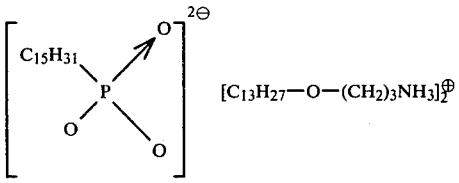

The so-prepared anti-wear additives may be added to fuels (including alcohol, gasoline, gasohol etc.) or to antifreeze. These compositions may be particularly found to be effective when added to absolute alcohol fuels typified by those available commercially containing compounds including ethers, esters, acids, etc.

The so-prepared anti-wear additives may be added to a fuel in minor wear-inhibiting amount of about 0.003–10 w % preferably 0.01–6 w %, more preferably 0.2–3 w %, say 1 w %. Larger amounts may be employed but may not be necessary.

It is a feature of this invention that the fuel composition so prepared is characterized by its increased ability to significantly reduce scar diameters (wear) in the Four-Ball Wear Test.

The Four Ball Wear Test is carried out by securely clamping three highly polished steel balls (each 0.5 inch in diameter) in a test cup in an equilateral triangle in a horizontal plane. The fourth highly polished steel ball, resting on the three lower balls to form a tetrahedron, is held in a chuck. A weight lever arm system applies weight to the test cup, and this load holds the balls together. In the standard test, the speed of rotation is 1800 rpm; the load is 5 kilograms. The assembly is submerged in the liquid to be tested. The standard test is carried out at ambient temperature for 30 minutes. As the chuck and upper ball rotate against the fixed lower balls, the friction of the upper ball rotating in relation to the lower balls produces a wear-scar the diameter of which (i.e. the depth along a diameter of the ball) is measured. The average of the wear on the three lower balls is the rating assigned (in millimeters).

It is observed that the use of the technique of this invention permits reduction in the average scar diameter by as much as 25%–35%. A reduction of 10% is a significant reduction.

DESCRIPTION OF PREFERRED EMBODIMENTS

Practice of this invention will be apparent to those skilled in the art from the following examples wherein, as elsewhere in this specification, all parts are parts by weight unless otherwise specified.

EXAMPLE I

In this example which illustrates the best mode known to me of practicing the process of this invention, there is added to a reaction vessel 13.8 parts of tetradecyl phosphonic acid and 28.9 parts of Armeen EA-13 brand of $C_{13}H_{27}$—O—$(CH_2)_3$—$NH_2$. This corresponds to a 1:1 mole ratio. The mixture is agitated at room temperature of 25° C. for 0.75 hours.

A test formulation is made up containing 100% absolute ethanol containing 1 w % of the above reaction product. This formulation was subjected to the four-ball test. The Average Scar Diameter was 0.23 mm.

EXAMPLE II

In this Example, the test procedure of Example I is carried out except that dilauryl phosphate was used instead of the decyl phosphonate. The Average Scar Diameter was 0.32 mm.

EXAMPLE III*

In this control Example, the test procedure of Example I is carried out with no additive i.e. the medium tested is 100% absolute ethanol. The Average Scar Diameter is 0.4775 mm.

TABLE

| Example | Average Scar Diameter mm |
|---|---|
| I | 0.23 |
| II | 0.32 |
| III* | 0.4775 |

It is apparent that use of the preferred embodiment of this invention (Example I) desirably increased the wear-inhibiting property of the ethanol by over 200% (0.4775/0.23); the less preferred phosphate embodiment of Example II gave a lesser degree of improvement-about 150% (0.4775/0.32) which is still substantial.

Results comparable to Example I may be attained if the addition is

TABLE

| Example | | Additive |
|---|---|---|
| IV | $C_{12}H_{25}O$—$(CH_2)_3$—$NH_3^+$ | 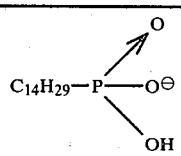 |
| V | $C_{14}H_{29}$—O$(CH_2)_3$—$NH_3^+$ | 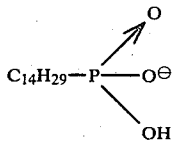 |
| VI | $[C_{15}H_{31}$—O$(CH_2)_3$—$NH_3]_2^+$ | 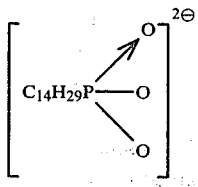 |

TABLE-continued

| Example | | Additive |
|---|---|---|
| VII | $[C_{16}H_{33}$—O$(CH_2)_3$—$NH_3]_2^+$ | 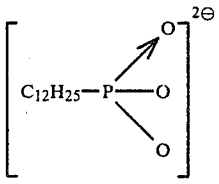 |

Results comparable to those of Example I may be obtained if the fuel is as follows:

TABLE

| Example | Fuel |
|---|---|
| VIII | absolute methanol |
| IX | Gasohol containing 90 v % gasoline and 10 v % absolute ethanol |
| X | absolute ethanol |

Although this invention has been illustrated by reference to specific embodiments, it will be apparent to those skilled in the art that various changes and modifications may be made with clearly fall within the scope of this invention.

We claim:

1. A fuel composition for internal combustion engines comprising:

(a) a major portion of a fuel containing (i) at least one alcohol selected from the group consisting of ethanol and methanol and (ii) gasoline in amount of 0–50 volumes per volume of alcohol; and (b) a minor wear-inhibiting amount, 0.2–3 w %, of, as a wear-inhibiting additive, a reaction product of (i) an amine having the formula $(ROR'')_a$-$NH_{3-a}$ wherein R contains 1–30 carbon atoms and is selected from the group consisting of alkyl, alkenyl, alkaryl, aralkyl, cycloalkyl, and aryl groups and R'' is a divalent hydrocarbon group containing 1–30 carbon atoms and is selected from the group consisting of alkylene, alkenylene, alkarylene, aralkylene, cycloalkylene, and arylene groups, and a is an integer 1–3 with (ii) a phosphonic acid

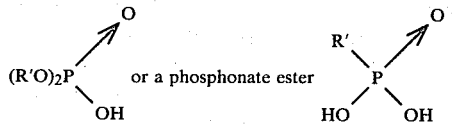

wherein R' contains 1–30 carbon atoms and is selected from the group consisting of alkyl, alkenyl, alkaryl, aralkyl, cycloalkyl, and aryl.

2. A fuel composition for internal combustion engines as claimed in claim 1 wherein said fuel is an alcohol.

3. A fuel composition for internal combustion engines as claimed in claim 1 wherein said fuel is methanol.

4. A fuel composition for internal combustion engines as claimed in claim 1 wherein said fuel is ethanol.

5. A fuel composition for internal combustion engines as claimed in claim 1 wherein said fuel is a commercial ethanol.

6. A fuel composition for internal combustion engines as claimed in claim 1 wherein said fuel is a commercial ethanol containing acid.

7. A fuel composition for internal combustion engines as claimed in claim 1 wherein said fuel is a commercial ethanol containing acetic acid.

8. A fuel composition for internal combustion engines as claimed in claim 1 wherein said fuel is a gasohol.

9. A fuel composition for internal combustion engines as claimed in claim 1 wherein said fuel is substantially anhydrous.

10. A fuel composition for internal combustion engines as claimed in claim 1 wherein said fuel contains less than 0.3 v % water.

11. A fuel composition as claimed in claim 1 wherein said amine is $ROR''\text{-}NH_2$.

12. A fuel composition as claimed in claim 1 wherein said amine is $ROR''\text{-}NH_2$ wherein R is a $C_6$-$C_{15}$ alkyl.

13. A fuel composition as claimed in claim 1 wherein said amine is $ROR''\text{-}NH_2$ wherein R'' is a $C_2$–$C_3$ straight chain alkyl.

14. A fuel composition as claimed in claim 1 wherein said amine is $ROR''\text{-}NH_2$ wherein R is a $C_6$–$C_{15}$ straight chain alkyl and R'' is a $C_2$–$C_3$ straight chain alkyl.

15. A fuel composition as claimed in claim 1 wherein said amine is $C_{13}H_{27}O\ CH_2CH_2CH_2\text{—}NH_2$.

16. A fuel composition as claimed in claim 1 wherein said amine is $(ROR'')_3N$.

17. A fuel composition as claimed in claim 1 wherein said amine is $(ROR'')_3N$ wherein R is a $C_6$–$C_{15}$ alkyl.

18. A fuel composition as claimed in claim 1 wherein said amine is $(ROR'')_3N$ wherein R'' is a $C_2$-$C_3$ straight chain alkyl.

19. A fuel composition as claimed in claim 1 wherein said amine is $(ROR'')_3N$ wherein R is a $C_6$-$C_{15}$ straight chain alkyl and R'' is a $C_2$-$C_3$ straight chain alkyl.

20. A fuel composition as claimed in claim 1 wherein said amine is $(C_{13}H_{27}\ O\ CH_2CH_2CH_2)_3N$.

21. A fuel composition as claimed in claim 1 wherein said amine is $(ROR'')_2\ NH$ .

22. A fuel composition as claimed in claim 1 wherein said amine is $(ROR'')_2\ NH$ wherein R is a $C_6$-$C_{15}$ alkyl.

23. A fuel composition as claimed in claim 1 wherein said amine is $(ROR'')_2\ NH$ wherein R'' is a $C_2$–$C_3$ straight chain alkyl.

24. A fuel composition as claimed in claim 1 wherein said amine is $(ROR'')_2\ NH$ wherein R is a $C_1$–$C_{15}$ straight chain alkyl and R'' is a $C_2$–$C_3$ straight chain alkyl.

25. A fuel composition as claimed in claim 1 wherein said amine is $(C_{13}H_{27}O\ CH_2CH_2CH_2)_2\ NH$ .

26. A fuel composition as claimed in claim 1 wherein said phosphorus ester has the formula

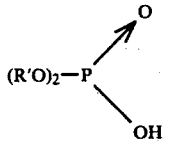

wherein R' is a $C_{10}$–$C_{18}$ alkyl.

27. A fuel composition as claimed in claim 26 wherein R is a $C_{10}$–$C_{18}$ alkyl and the phosphorus ester is an alkyl phosphate ester.

28. A fuel composition as claimed in claim 27 wherein the phosphorus ester is dilauryl phosphate

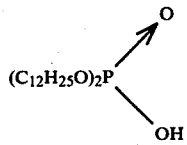

29. A fuel composition as claimed in claim 27 wherein the phosphorus ester is di-decyl phosphate

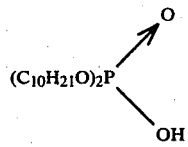

30. A fuel composition as claimed in claim 1 wherein the phosphonate ester contains 5–40 carbon atoms.

31. A fuel composition as claimed in claim 1 wherein the phosphonic acid is tetradecyl phosphonate.

32. A fuel composition as claimed in claim 1 wherein the amine and the ester are reacted in substantially equimolar quantities.

33. A fuel composition as claimed in claim 1 wherein the amine and the phosphonic acid are reacted in mole ratio of one phosphonic acid: two amine.

34. A fuel composition comprising a major portion of a fuel containing (i) at least one of ethanol and methanol and (ii) gasoline in amount of 0–50 volumes per volume of alcohol; and (i) 0.2 w %-10 w % of the reaction product of $C_{13}H_{27}$—O—$(CH_2)_3$—$NH_2$ and (ii) di-lauryl phosphate.

35. A fuel composition comprising a major portion of a fuel containing (i) at least one of ethanol and methanol and (ii) gasoline in amount of 0–50 volumes per volume of alcohol; and (i) 0.2 w %-10 w % of the reaction product of $C_{13}H_{27}$-O-$(CH_2)_3$-$NH_2$ and (ii) an equimolar amount of tetradecyl phosphonic acid.

36. A fuel composition comprising a major portion of a fuel containing (i) at least one of ethanol and methanol and (ii) gasoline in amount of 0–50 volumes per volume of alcohol; and (i) 0.2 w %-10 w % of the reaction product of $C_{13}H_{27}$-O-$(CH_2)_3$-$NH_2$ and (ii) a bimolar amount of tetradecyl phosphonic acid.

37. The method of improving the wear-resistance properties of a fuel containing (i) at least one alcohol selected from the group consisting of ethanol and methanol and (ii) 0–50 volume of gasoline per volume of alcohol which comprises adding to said fuel a minor, wear-inhibiting amount of 0.2 -3 w % of the reaction product of (i) an amine having the formula $(ROR'')_a$-$NH_{3-a}$ wherein R contains 1–30 carbon atoms and is selected from the group consisting of alkyl, alkenyl, alkaryl, aralkyl, cycloalkyl, and aryl groups and R'' is a divalent hydrocarbon group containing 1–30 carbon atoms and is selected from the group consisting of alkylene, alkenylene, alkarylene, aralkylene, cycloalkylene, and arylene groups, and a is an integer 1–3 with (ii) a phosphonic acid

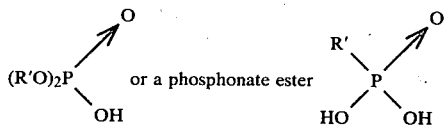

wherein R' contains 1–30 carbon atoms and is selected from the group consisting of alkyl, alkenyl, alkaryl, aralkyl, cycloalkyl, and aryl.

* * * * *

UNITED STATES PATENT AND TRADEMARK OFFICE

CERTIFICATE OF CORRECTION

PATENT NO. : 4,416,667

DATED : 22 November 1983

INVENTOR(S) : BENJAMIN J. KAUFMAN et al

It is certified that error appears in the above-identified patent and that said Letters Patent is hereby corrected as shown below:

Abstract Page, in the title, line 5 and 6, after "PHOSPHATE", insert -- ESTER --

Column 1, line 5, after "PHOSPHATE", insert -- ESTER --; line 6, correct the spelling of "PHOSPHONIC".

Cancel "phosphorus", insert -- phosphate -- in the following places: Column 10, lines 34, 48, and 58.

Cancel "phosphonate", insert -- phosphonic acid -- in the following places: Abstract, lines 5 and 6; (both occurrences) column 5, line 20; column 7, lines 21 and 40;

column 11, line 2

UNITED STATES PATENT AND TRADEMARK OFFICE

CERTIFICATE OF CORRECTION

PATENT NO. : 4,416,667

DATED : 22 November 1983

INVENTOR(S) : BENJAMIN J. KAUFMAN et al

It is certified that error appears in the above-identified patent and that said Letters Patent is hereby corrected as shown below:

Column 3, line 1, correct the spelling of "octyls"

Column 4, line 58, correct the spelling of "acids"

Column 2, line 19, correct the spelling of "be"

After "phosphate", insert -- ester -- in the following places: Abstract, line 5; column 4, line 57

Cancel "phosphonic acid", insert -- phosphate ester -- column 1, line 46; column 8, line 49; column 12, line 18

Cancel "phosphonate ester", insert -- phosphonic acid -- in the following places: Column 8, line 54, column 12, line 23.

Signed and Sealed this

Tenth Day of September 1985

[SEAL]

Attest:

DONALD J. QUIGG

Attesting Officer Acting Commissioner of Patents and Trademarks - Designate